US006453908B1

(12) United States Patent
Caballero

(10) Patent No.: US 6,453,908 B1
(45) Date of Patent: Sep. 24, 2002

(54) WATER PIPE

(75) Inventor: Eric Lawrence Caballero, La Palma, CA (US)

(73) Assignee: Eric L. Caballero, La Palma, CA (US)

( * ) Notice: Subject to any disclaimer, the term of this patent is extended or adjusted under 35 U.S.C. 154(b) by 8 days.

(21) Appl. No.: 09/672,255

(22) Filed: Sep. 28, 2000

(51) Int. Cl.[7] ..... A24F 1/30
(52) U.S. Cl. ..... 131/173; 131/200
(58) Field of Search ..... 131/173, 330; D27/162

(56) References Cited

U.S. PATENT DOCUMENTS 1,579,703 A * 4/1926 Grant ..... 131/173
2,035,384 A * 3/1936 Hinchliff ..... 66/170
2,522,381 A * 9/1950 Kramer ..... 215/12.1

FOREIGN PATENT DOCUMENTS

GB 1011208 * 11/1965 ..... 131/173

OTHER PUBLICATIONS

"Science and Invention for Jul.", 1927.*

* cited by examiner

*Primary Examiner*—James Derrington
*Assistant Examiner*—Dionne A. Walls
(74) *Attorney, Agent, or Firm*—Eric Caballero

(57) ABSTRACT

The water pipe has a water chamber as for example a small open mouth bottle into which a stopper may be inserted or attached. The stopper has two ducts therein which are approximately 90 degree ducts. A smoke inlet tube is inserted into an exterior inlet port of the first duct and a smoke dispensing tube is inserted into an interior outlet port. A hollow stem is inserted into an exterior outlet port of the second duct. The water chamber is then partially filled with a fluid, and the stopper is attached at the open mouth upper end of the water chamber. A cigarette may then be inserted into the smoking inlet tube and ignited. When a user inhales at the hollow stem mouthpiece, smoke is drawn into the water chamber and through the fluid to exit the chamber through the hollow stem.

6 Claims, 1 Drawing Sheet

WATER PIPE

BACKGROUND OF THE INVENTION

1. Field of the Invention

This invention relates to devices used to filter smoke from cigarettes, cigars and the like. The improved device provides a simple means to filter smoke through water or other appropriate fluids prior to inhalation by the user.

2. Description of Related Art

There are known a wide variety of water pipe, filters, bongs and similar devices used to filter smoke from a burning substance prior to inhalation. A survey of such devices, uses and patents is contained in U.S. Pat. No. 5,476,110, issued Dec. 19, 1995. The known art is complicated making the devices difficult to use and clean.

An example is U.S. Pat. No. 5,476,110 which requires apertures in the sides of the water chamber for inserting the smoke inlet and outlet tubes. This structure complicates the fabrication of the water chamber and requires friction fittings for the tubes.

In the instance of U.S. Pat. No. 3,703,179, issued Nov. 21, 1972, there are openings in the cap for smoke inlet and outlet tubes; however, the overall structure is complex with regard to the cap openings and the corresponding structure of the tubes. This device also uses porous filters which further complicates the use and cleaning of the device.

The present invention uses a cap or stopper having a friction fit into a water chamber open upper end. The stopper has two approximately right angle passages therethrough into which relatively simple tubular members are inserted. Modifications to the water chamber to provide inlet and outlet apertures are not required and the device may be easily disassembled for cleaning.

SUMMARY OF THE INVENTION

One object of the present invention is an improved water pipe allowing ease of assembly and disassemble. Another object is ease of cleaning the water pipe elements. A further object is a device which is small, easily transportable and adaptive for various smoking products. Yet another object is use of water chambers such that apertures for inlet and outlet of smoke are not required, only an open upper end being required.

In accordance with the description presented herein, other objectives of this invention will become apparent when the description and drawings are reviewed.

DESCRIPTION OF THE PREFERRED EMBODIMENT

The water pipe (1) is comprised of a water chamber, a closure means or stopper for the open upper end of the water chamber, and a plurality of tubes for insertion into the openings of ducts in the stopper. There may also be a removable fine mesh screen associated with the outlet duct interior port. The water pipe may also be used with a pouch for enclosing the water chamber.

Figure 1:
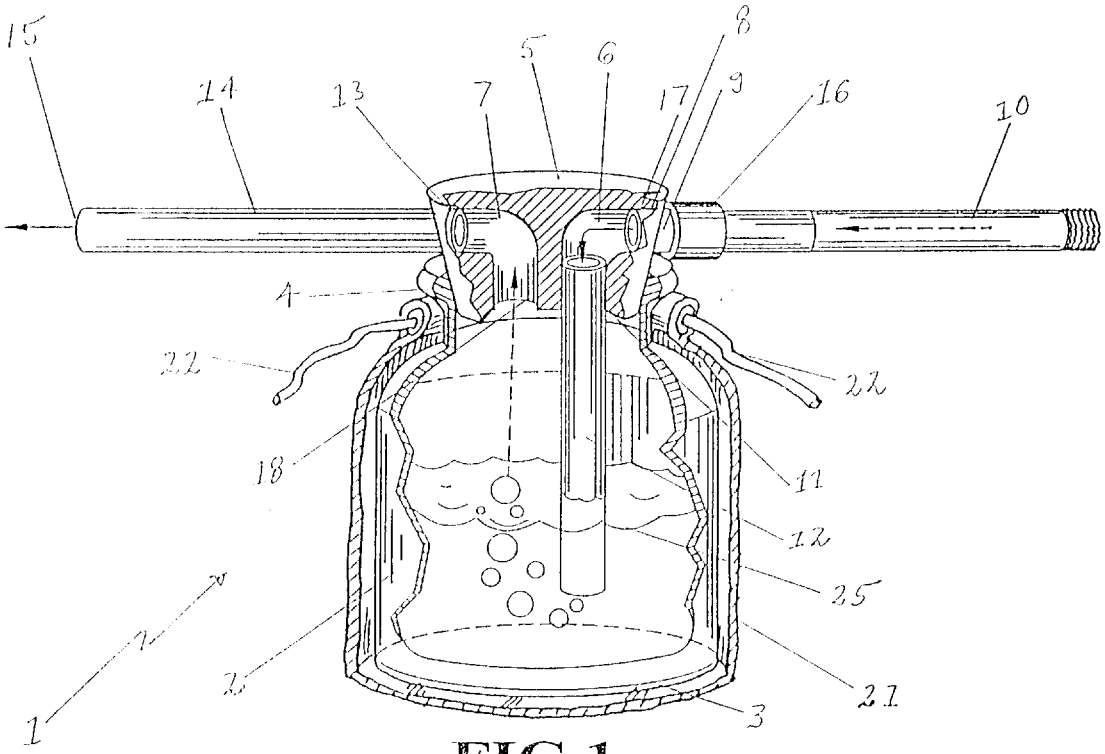
FIG. 1 illustrates a side elevation perspective view with cut away of the water pipe.

Referring to FIG. 1, a water chamber (2) has a bottom (3) and an open upper end (4). The open upper end (4) is closed by means of a stopper (5) being pushed into the upper end (4) to be retained by friction. The water chamber (2) may be made of glass, plastic, metal or other suitable rigid material for retaining fluids. The stopper (5) may be constructed of natural or synthetic rubber, cork, elastomers and the like. The stopper (5) or like closure is releasably fastened to the water chamber (2) by frictional forces.

The stopper (5) has a first opening or inlet duct (6) and a second opening or outlet duct (7) illustrated as elbow or approximately 90 degree ducts therethrough. The two ducts (6,7) may be of the same diameter to allow interchangeability of tubes for inlet and outlet.

The inlet duct (6) at an exterior inlet port (8) has a smoking inlet tube (9) inserted therein. The smoking inlet tube (9) has provision for insertion of a cigarette (10), cigar and the like smoking products to be inserted. The inlet duct (6) at an interior outlet port (11) has a smoke dispensing tube (12) inserted therein which smoke dispensing tube (12) extends from the interior outlet port (11) to the approximate bottom (3) of the water chamber (2).

The outlet duct (7) at an exterior outlet (13) has a hollow stem (14) inserted therein. The hollow stem (14) terminates in a mouthpiece (15) suitable for the intended user.

In use the water chamber (2) is filled with a suitable filtering fluid (25) such as water. The tubes (9,12,14) are inserted into the appropriate ducts as herein described and the stopper (5) is inserted into the open upper end (4) of the water chamber (2). A cigarette (10) is then inserted into the exterior inlet port (8). When the cigarette (10) is burning the user's suction on hollow stem (14) causes the smoke products to be drawn into the water (25), to bubble up to the surface, and to be drawn out the hollow stem (14) to the user.

The smoking inlet tube (9) may have provision for a releasably attachable inlet fitting (16) to accommodate the sizes of a variety of smoke generating products. There may also be a variety of interchangeable smoking inlet tubes (9) to accommodate such products wherein the exterior inlet port end (17) size remains constant.

Figure 2:
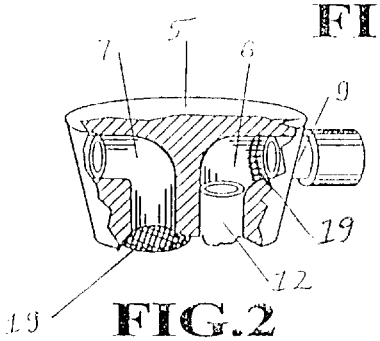
FIG. 2 illustrates a cut away view of the stopper with filter screen attached.
Figure 3:
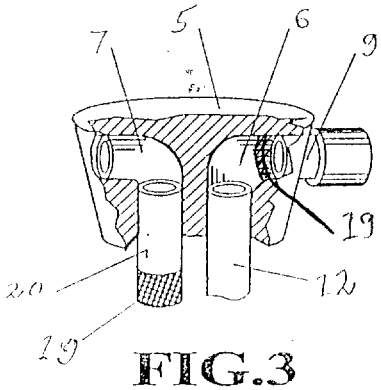
FIG. 3 illustrates a cut away view of the stopper with outlet tube.

Referring to FIGS. 2 and 3, the interior inlet port (18) of the outlet duct (7) may have a fine mesh screen (19) to inhibit escape of water vapor particles. A short interior inlet tube (20) may also be used and have attached a fine mesh screen (19). The mesh screen (19) is formed of suitable material such as metal, plastic and the like.

Referring again to FIG. 1, a pouch (21) is illustrated as enclosing the water chamber (2). The pouch (21) may be constructed of leather, fabrics and like materials. With the water chamber (2) enclosed the water pipe (1) is easier to grasp and hold and the water chamber (2) has a degree of protection. The pouch (21) may be used with or without a draw string (22).

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for filtering burning products smoke prior to inhalation by a user comprising:

a water chamber having a bottom and an open upper end for receiving a fluid therein;

a stopper with a first duct and a second duct contained therein and the stopped sized to be removably attached to the open upper end;

a smoking inlet tube inserted into an exterior inlet port of the first duct wherein the smoking inlet tube removably engages a burning product;

a smoke dispensing tube inserted into an interior outlet port of the first duct wherein the smoke dispensing tube extends downwardly to be below the fluid contained in the water chamber; and a hollow stem inserted into an exterior outlet port of the second duct, wherein an interior inlet port of the second duct has a mesh screen attached thereto, whereby said mesh screen inhibits escape of water vapor particles.

2. The device as in claim 1 wherein there is an inlet fitting removably attached to the smoking inlet tube.

3. The device as in claim 1 wherein the smoking inlet tube has a variety of shapes to accommodate a variety of burning products with an exterior inlet port end remaining a constant shape.

4. The device as in claim 1 wherein a pouch substantially encloses the water chamber.

5. The device as in claim 4 wherein the pouch has a draw string at an upper end thereof.

6. The device as in claim 1 wherein the mesh screen is replaced with an interior inlet tube inserted into the interior inlet port and having a mesh screen attached to an end thereof.

* * * * *